US007475439B1

(12) United States Patent
Cox et al.

(10) Patent No.: US 7,475,439 B1
(45) Date of Patent: Jan. 13, 2009

(54) MASSAGE TABLE APPARATUS

(75) Inventors: Ian J. Cox, Steamboat Springs, CO (US); Shelley L. Felch, Steamboat Springs, CO (US)

(73) Assignee: Shellian Corporation, Steamboat Springs, CO (US)

( * ) Notice: Subject to any disclaimer, the term of this patent is extended or adjusted under 35 U.S.C. 154(b) by 35 days.

(21) Appl. No.: 11/726,092

(22) Filed: Mar. 21, 2007

Related U.S. Application Data

(60) Provisional application No. 60/785,053, filed on Mar. 23, 2006.

(51) Int. Cl.
*A61G 13/00* (2006.01)
*A61G 13/12* (2006.01)

(52) U.S. Cl. ..... 5/632; 5/638; 5/905; 5/908

(58) Field of Classification Search ..... 5/632, 5/620, 630, 638, 731, 905, 908, 735, 602, 5/930, 631; 606/243
See application file for complete search history.

(56) References Cited

U.S. PATENT DOCUMENTS 2,182,861 A * 12/1939 Albert ..... 5/722
2,819,133 A * 1/1958 Party ..... 5/602
3,165,630 A * 1/1965 Bielat et al. ..... 378/37
3,623,170 A * 11/1971 Staley et al. ..... 5/695
4,596,384 A * 6/1986 Blosser ..... 5/613
4,903,689 A 2/1990 Lannertone
5,297,303 A * 3/1994 Stafford et al. ..... 5/613
D364,464 S 11/1995 Gigante et al.
6,151,734 A 11/2000 Lawrie
6,428,497 B1 * 8/2002 Crouch ..... 602/32
6,615,431 B2 9/2003 Lin
6,934,988 B1 8/2005 Wetzler et al.
7,134,158 B2 * 11/2006 Tokarz ..... 5/632
2004/0123392 A1 * 7/2004 Stewart et al. ..... 5/632

* cited by examiner

*Primary Examiner*—Alexander Grosz
(74) *Attorney, Agent, or Firm*—James K. Poole, Esq.

(57) ABSTRACT

A massage table with attachments designed for use by a couple in an intimate setting for the mutual satisfaction of both persons engaged in the massage is disclosed. A preferred embodiment includes a pair of support surfaces spaced a predetermined distance apart for accommodating the body contours of a woman lying in a face down position; a void bounded by the two support surfaces; a pair of lateral support members extending upward from one of the two support surfaces; and a headrest support member which may accommodate the subject in either a face down or a face-up position. The massage table may include a number of built in attachments or accessories, such as mirrors, lights, sleeves or pockets for lotions and oils, aromatherapy pouches, heating elements, and other devices customary to the art of massage.

11 Claims, 2 Drawing Sheets

MASSAGE TABLE APPARATUS

REFERENCE TO RELATED APPLICATION

This application claims priority from Applicant's provisional application, U.S. Ser. No. 60/785,053, filed Mar. 23, 2006, which is also incorporated herein by reference.

BACKGROUND OF THE INVENTION

1. Field of the Invention (Technical Field)

This invention relates to the field of massage and therapeutic body treatments. More specifically, it relates to a massage table designed for accommodating the body shape of a woman lying in a face down position, but that may also be used to support a man or woman in this or other positions, and is designed particularly for use by a couple in an intimate setting for the mutual satisfaction of both persons engaged in the massage.

2. Background Art

A great number of people enjoy the benefits of massage. Whereas early massage treatment was limited mainly to those persons experiencing back pain or needing rehabilitation from a neck or back trauma, increasingly the art of massage is being used purely for relaxation and enjoyment. There are a number of schools and programs for becoming a skilled masseur or masseuse, and are also a number of instructional courses, videos, books, and other learning devices by which a person may learn to give either a basic or a more complex massage with relative ease. Massages have evolved over the past fifty years, and today many massage treatments incorporate different elements, for example the introduction of warm or cool elements placed against the receiving person's skin. The massage may be applied delicately, or may be more of a deep tissue massage, and may be focused on a particular area of the person's body. Most massage treatments begin with the person receiving the massage lying face down on a platform, table or other surface. The most common position for the person performing the massage treatment is standing adjacent to the receiving person and leaning over the person so as to apply the necessary pressure to various points along the person's body.

Early massage surfaces were called beds or tables, and were designed primarily for use in a clinical environment. Some of these early art tables include legs that can be adjusted so that the platform could be raised or lowered to accommodate the height of the masseur (or masseuse). In almost all cases the massage table required the masseur to be in a standing position, and the table comprised a flat surface and did not account for the body shape or contour of the person who would be receiving the massage.

Later, the need to have the receiving person visit a treatment center or remote location became undesirable, and more frequently the masseur would travel to the person's home, hotel or work site to perform the massage. It was during this time that the need for a collapsible and portable massage table became apparent. Today, the traveling masseuse/masseur represents a large segment of the massage industry. But these massage tables are not designed to accommodate the type of massage between a man and a woman (or same-sex couple) in an intimate setting, such as a massage performed by a husband for his wife. These massage tables are specifically not designed for the environment where such massage would likely take place, such as upon a bed. Furthermore, these tables do not address the problem of sliding laterally along the surface of the table as a result of the force of the massage. This is particularly a problem when the receiving person or massage subject has perspired onto the massage table surface or when oils or lotions have been applied to the person's skin.

There are a number of other problems associated with prior art massage tables for use in an intimate setting. For example, the necessity to have the massage table oriented to ensure the comfort and ease of use for both the person receiving the massage and the person giving the massage is not addressed. These prior art tables only allow a person to stand adjacent to one side of the table in order to perform the act of massage. If the legs are removed, these tables still have the disadvantage of being difficult for the masseur to position himself near enough to provide the required directional pressure and technique on the massage subject either while standing or kneeling next to the subject. The strain and discomfort caused to the masseur or the masseuse could become significant in a short period of time. It is even possible that the masseur or masseuse could need a massage to recover from this experience. Therefore, a need exists for a massage table or bed addressing these problems and others, and that is designed for massage performed in an intimate setting between two adults.

There are references found in the prior art attempting to address some of these problems identified above. For example, in U.S. Pat. No. 6,615,431, a common portable massage bed is disclosed. This massage bed includes a multipart frame, height and inclination adjustments, and a multisection mattress. This massage bed may be disassembled and collapsed to accommodate transportation of the apparatus, and otherwise primarily addresses the needs of a traveling masseuse or masseur identified above. This apparatus discloses separate mattress sections and accompanying frame sections positioned adjacent and relative to each other, and therefore does not provide guidance to the comforts which can be provided by the current invention. It also does not teach the use of the structure by a person who is in a position other than standing to either side of the person receiving the massage, and does not permit a massage person to position himself nearer to the receiving person's hips and lower back. Its benefit is primarily to allow the user to disassemble the table and store it in a convenient carrying case. This invention also does not allow the masseur to have access to other areas of the receiving person's body while lying face down, particularly the area of a woman's breasts.

One attempt to provide a massage apparatus for a more intimate setting is disclosed in U.S. Pat. No. 6,151,734. This patent discloses the use of a head cushion support apparatus which may be positioned between two surfaces, such as the top and bottom mattress of a bed. This invention, while it allows the receiving person to lie on a more comfortable surface, does not solve the problems of discomfort described above, nor does it teach the ability to modify the bed surface to accomplish the other benefits of the current invention.

U.S. Pat. No. D364,464 discloses a design including a combined massage and treatment cushion with a pair of recesses for a receiving person's chest and chin. This design does partially eliminate the discomfort caused to a woman positioned face down on the cushion, but does not allow the masseur to have access to these other areas of the person's body. This design is also dependent on a number of assumptions about a person's body type, for example the position of a woman's breasts in relation to her neck, chin and head, and therefore may be limited to use by receiving persons having certain body sizes or shapes. It otherwise does not solve the problems identified above of providing a massage table that is appropriate for a more intimate massage.

Another reference that discloses an ability to accommodate a female body shape is U.S. Pat. No. 6,934,988. Like the design patent discussed in the previous paragraph, this invention includes a recess or pocket for supporting a woman's breasts when lying in a face down position. However, this table is limited to supporting the breasts, and not providing access to this area of the body. This invention does not provide the masseur with the ability to position himself behind and above the receiving person's hips, lower back and torso in order to provide a focused massage to those areas. It also does not disclose the ability of a masseur to be in the kneeling position while performing the act of massage.

Another such example is U.S. Pat. No. 4,903,689 issued to Lannertone. Unlike the pocketed recess of the previous two references, this patent teaches the use of spaced shoulder supports that may be slidable along a single axis to accommodate the body type of the receiving person. This patent does not come any closer than the other prior art references in teaching a support system that provides access to this area of a woman's body, and also does not disclose or suggest the other benefits of the current invention. Therefore these prior art references have failed to solve the problems presented with massage tables, particularly when used in an intimate setting.

SUMMARY OF THE INVENTION

These and other problems exist in the area of massage tables and other therapeutic treatment surfaces. Thus, a need persists to provide a massage table which allows the masseur to either be in a standing position or a kneeling position, and which further accommodates the ability to position the masseur between the receiving person's legs to provide a focused massage on the receiving person's hip, torso and lower back areas. A need also arises to provide a table which may be used by two persons in a more intimate setting, such as on a bed or in a Jacuzzi or bathtub, and which is particularly suitable for a woman either lying in a face down or a face-up position. Furthermore, the need to provide support members which prevent the receiving party from moving horizontally along the table during the massage is also a primary objective of the present invention.

In accordance with the present invention, a massage table is provided which comprises a bottom plate with vertical structures at each end supporting two elevated substantially horizontal support surfaces spaced a predetermined distance apart, a central void bounded by the inner edges of these structures, a pair of vertical support members mechanically fastened to either side of the structures (and, optionally, to the bottom plate) and extending upward from the sides of one of the two support surfaces. This support surface is adapted to support the hip and pelvic area of the massage subject, while the other support surface is adapted to support the shoulder area of the subject. A headrest with a breathing space in the center can be removably attached to the outer vertical surface of the structure supporting the latter support surface, and is mounted with elongated elements which permit it to be positioned a suitable range of distances from the vertical surface to which it is attached, and also rotated 180 degrees alone its horizontal axis to expose a different headrest surface. The vertical support members can be fitted with resilient had grips at their upper ends, and are so positioned as to allow for two distinct body positions of the subject, with the subject's legs on either the interior or exterior of the vertical supports.

The void between the structures supporting the horizontal support surfaces is designed to accommodate a woman massage subject's breasts while she is positioned on the table, and is open on both sides of the table to allow the masseur access to the subject's body. The table is configured to have at least one mirror emplaced near the bottom plate, facing upward to allow for improved viewing of the subject's body. For example, at least one mirror can placed in the void between the support structures and another placed at the end of the table just behind the structure supporting the horizontal support surface for the subject's pelvic area. Furthermore, at least one of these mirrors can be illuminated by lighting means such as small electric lights placed in at least one of the recesses between the first and second support surfaces and the bottom plate.

The table can have built-in accessories such as multiple pockets installed along at least one side of at least one of the structures supporting the horizontal support surfaces, and/or inside the recesses under at least one of these support surfaces. The horizontal support surfaces are preferably upholstered or padded and covered with a moisture-repellent, washable material, as is the head rest.

These and other objects, aspects and advantages of the invention will become apparent from perusal of the following detailed description, the appended claims and the following drawings.

BRIEF DESCRIPTION OF THE DRAWINGS

The accompanying drawings, which are incorporated into and form a part of the specification, illustrate a preferred embodiment of the present invention and, together with the description, serve to explain the principles of the invention. The drawings are only for the purpose of illustrating preferred and alternate embodiments of the invention, and are not to be construed as limiting the invention. In the drawings.

DETAILED DESCRIPTION OF PREFERRED EMBODIMENTS

Figure 1:
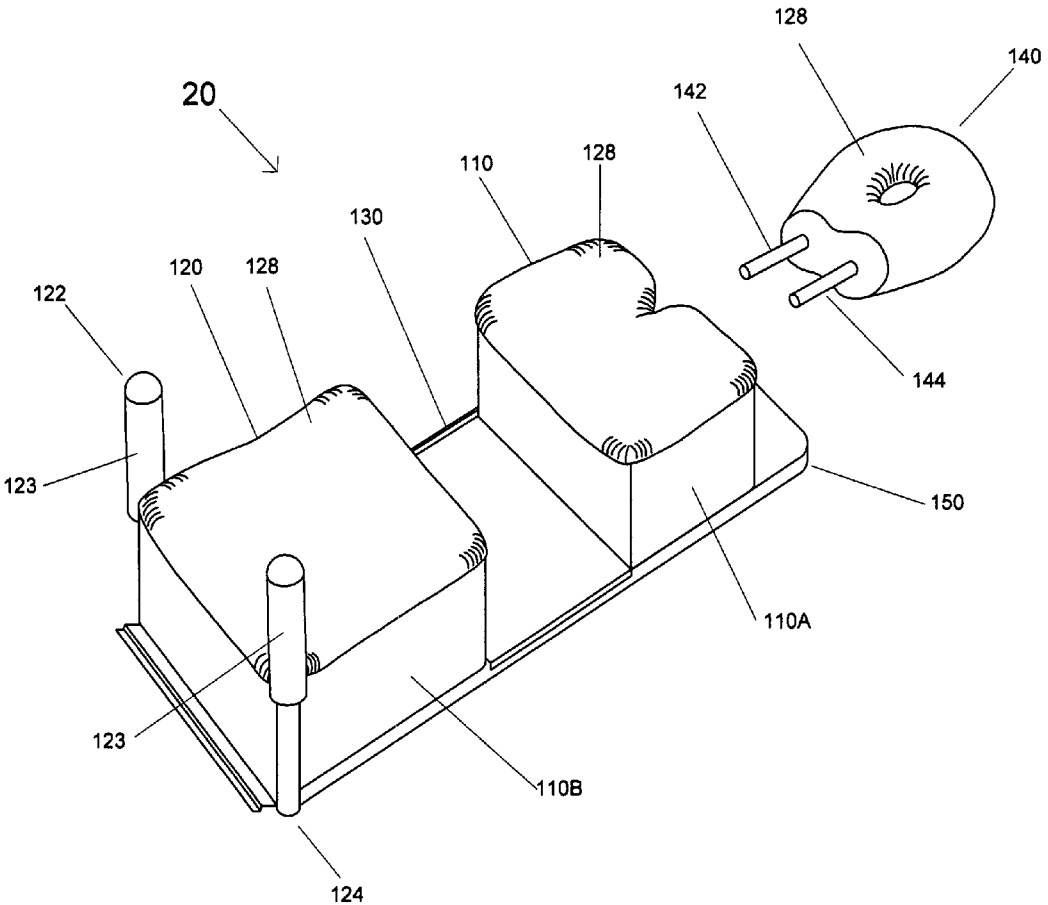
FIG. 1 is a perspective view of the massage table assembly in a preferred embodiment.
Figure 2:
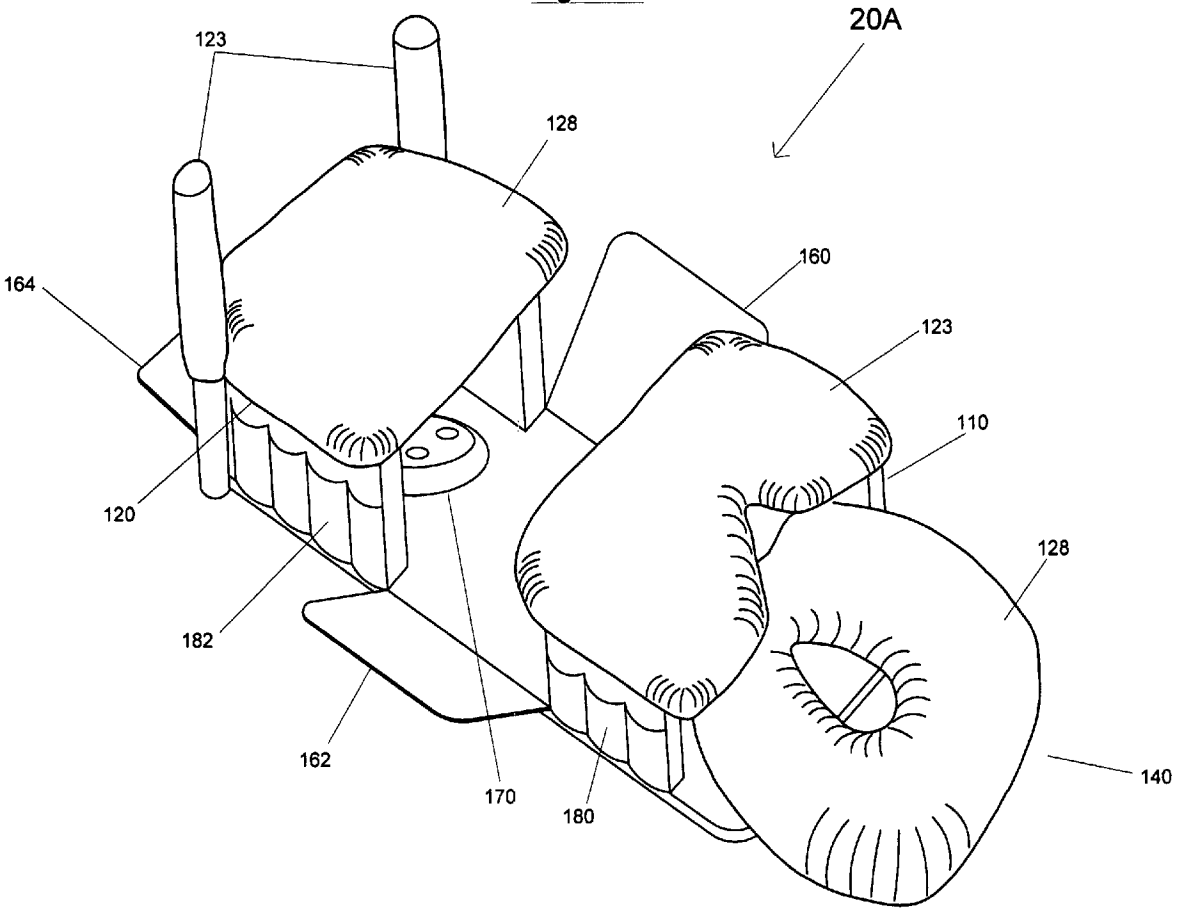
FIG. 2 is a perspective view of the massage table assembly in an alternate embodiment.

Embodiments of the present invention are illustrated in FIGS. 1 and 2. It is to be expressly understood that these descriptive embodiments are provided herein for explanatory purposes only and are not meant to unduly limit the claimed invention. Other embodiments of the present invention are considered to be within the scope of the claimed invention, including not only those embodiments that would be within the scope of one skilled in the art, but also as encompassed in technology developed in the future. Although the use of the massage table apparatus in conjunction with a bed or other bedroom surface is often used as an example for practicing the invention, it is used primarily for the purposes of understanding one application of the invention. It is to be expressly understood that other applications are contemplated for use with the present invention as well. Accordingly, the disclosure of preferred embodiments of the invention is intended to be illustrative, but not limiting of the scope of the invention which is set forth in the following description and drawings.

In the following discussion, the terms "masseur" and "masseuse" may be used interchangeably or alternatively, with the understanding that a massage practitioner of either sex can perform massage services for persons of the opposite or same sex on the massage table of the invention. Similarly, the massage "subject" can be a person of either gender, which may be different from or the same as the person administering the massage. Furthermore, the components of the various embodiments of the invention disclosed and illustrated herein may be described as having upper and lower surfaces and/or edges or first and second surfaces and/or edges, using a terrestrial frame of reference where "top" or "upper" surfaces and the like are opposite the surface of the earth from which the force of gravity attracts objects, assuming that the components are assembled and the embodiments are placed in their normal positions for use. Also, in some cases the embodiments and/or their components can be described as having "front" and "rear" portions according to the direction from which the table is intended to be used. Where used, the expression "and/or" is used in the sense of meaning A, B or A+B. The term is a shorthand form used to mean that either A or B or both can be present. In various figures, some components of the invention may be omitted or unlabeled for clarity.

In a preferred embodiment of the invention, the massage table assembly comprises the following parts: a pair of support surfaces spaced a distance apart, particularly for accommodating the body shape of a woman lying in a face down position; a void bounded by the two support surfaces; a pair of lateral support members extending upward from one of the two support surfaces; and a removable head support member which may accommodate either a face down or a face-up position for the subject. These components are each described in detail in FIGS. 1 and 2 and in the following detailed description.

Referring to FIG. 1, a massage table assembly 20 in a preferred embodiment comprises a first support surface 110 and a second support surface 120, which may be regarded as shoulder and hip support surfaces, respectively. The support surfaces can be mounted on any suitable structure providing a foundation able to support the weight of any subject, withstand the pressures and movements inherent in massage treatments, and position the surfaces at suitable heights above the base of the table. The boxlike structures 110A and 110B as shown have been found to be suitable, and allow space underneath the support surfaces for storage, lights and other accessories. The surfaces themselves can comprise any suitable material(s), but preferably comprise padded cushions 128 covered with moisture-resistant coated fabrics or other materials which are easily cleaned to remove sweat, oils and the like. The first support surface 110 is positioned a predetermined distance away from the second support surface 120, thereby creating a void 130 or cavity bounded by the interior side of the first support surface 110, the opposing side of the second support surface 120 and the bottom plate or base 150 of the massage table assembly. In this embodiment, the void 130 is used primarily for accommodating a woman's breasts when the woman massage subject is lying face down. The first support surface 110 and the second support surface 120 are spaced so as to accommodate subjects of different heights, torso lengths and body contours. In particular, the void 130 accommodates women with differing body contours in the area of the woman's breasts by allowing the woman to position her shoulders either more towards the far end of the first support surface 110 or towards the interior surface of the first support surface 110 as necessary to position the breasts within the void 130. In this embodiment, the woman lying face down is therefore given a more comfortable platform upon which to receive a focused massage, and particularly without receiving pressure from the support surface 110 upon her breasts. The void 130 is open on both sides of the massage table assembly 20 to allow the masseur to have access to this area, which may be desirable for couples engaged in a more intimate massage.

Referring again to FIG. 1, the massage table assembly 20 also includes a pair of lateral support members 122, 124 extending upward from the surface of the second support surface 120 to prevent lateral movement of the receiving person along the surface of the massage table assembly. Lateral support members 122, 124 are preferably securely mounted to both the corners or other suitable points on the second support surface 120, but also to bottom plate 150. Lateral movement of the massage subject may be prevented in two distinct ways: either positioning the receiving person's legs towards the interior side of each lateral support element 122, 124, so that the receiving person's hips are positioned on the second support surface 120; or by positioning the legs of the receiving person on the exterior side of each lateral support element 122, 124, so that the receiving person's hips are substantially removed from the second support surface 120, and the second support surface 120 is engaged primarily with the receiving person's torso. By allowing these two positions, the masseur can ensure that the receiving person does not move laterally along the surface of the massage table assembly 20, regardless of whether pressure is applied from the direction of the receiving person's head or from the receiving person's legs. The lateral support elements 122, 124 are positioned in such a way to allow at least two distinct body positions to be achieved by receiving persons of differing heights, so that the masseur can perform the same type of massage regardless of whether the person is shorter or taller than average, and without the concern of the receiving person moving laterally along the table and thereby causing discomfort. These two positions may also be accomplished when the person is lying on her back as opposed to lying face down.

Lateral support elements 122, 124 can be of any suitable material, including wood, metal and plastic compositions, and can optionally have cushioning materials such as plastic or rubber foams 123 covering at least portions of the upper exposed portions of the supports, with suitable coverings as described above.

The massage table assembly 20 in a preferred embodiment also comprises a headrest 140 attached to the far end of the first support surface 110. This headrest 140 in a preferred embodiment includes two elongated elements 142, 144 for removably engaging with holes in the first support surface 110 so that the headrest 140 may be positioned either closer to or farther away from the far end of the first support surface 110. The headrest 140 may also be completely disengaged from the first support surface 110 if necessary to provide a particular type of massage on the receiving person's neck or facial area. The elongated elements 142, 144 for engaging with the first support surface 110 are not centered along the vertical axis of the headrest 140, therefore allowing the headrest 140 to be rotated 180 degrees on a horizontal axis to present a different surface and accommodate the receiving person in a face-up position without causing additional discomfort.

FIG. 2 is a perspective view of the massage table 20A in an alternate embodiment. In this embodiment the table includes a number of optional and removable attachments, including mirrors 160, 162, 164, which are positioned to allow the masseur to have improved viewing of the receiving person's body, and in particular the areas that are not usually directly in the masseur's field of view while positioned above the receiving person. The attachments also include small incandescent or other types of lights 170, which may be positioned in recesses formed between the first support surface 110 and the bottom plate 150 or between the second support surface 120 and the massage table platform. The mirrors 160, 162, 164 also allow this light to be reflected upward and outward from the massage table and help to create a more intimate lighting level surrounding the massage table assembly 20A. In this embodiment, the incandescent bulbs or other light sources used with the lights 170 are of sufficient wattage to create the lighting necessary to allow the masseur to view the receiving person's body and perform the art of intimate massage. The light(s) can be powered by conventional household electricity, but preferably are battery-powered for convenience (not shown here). Mini-fluorescent lamps or light-emitting diodes (LEDs) can be used as alternatives to incandescent bulbs, and the lighting can be arranged to provide at least one color in addition to that emitted by conventional incandescent or fluorescent sources.

The attachments and built in components of this alternate embodiment 20A may also include a number of built-in sleeves or pockets 180, 182 for convenient placement of lotions, oils, brushes, pads, stones, acupuncture needles, aromatherapy pouches, or other tools and devices common in the art of massage. These sleeves 180, 182 may be placed on either or both sides of the first or second support surfaces 110, 120, or may be positioned in the recesses described above underneath the first and second support surfaces. The number of sleeves 180, 182 may vary with the expected needs of the users. These attachments are only a few of the additional elements contemplated for use with the invention in alternate embodiments. For example, warmers or heating elements (not shown here) may be incorporated within the lotion and oil sleeves and/or the support surfaces 110, 120 to provide a more pleasant massage experience. Other additional elements are considered to be useful with the present invention as well, and this alternative embodiment is not limited to the elements listed above, and are considered to be inclusive of other devices customary to the art of massage.

In a preferred embodiment or application, the massage table assembly 20 or 20A may be conveniently placed upon a bed surface, cushion or pad and thus allow the masseur or masseuse to comfortably perform the act of massage while in a kneeling position. One skilled in the art will appreciate that this position allows the person performing the massage to achieve greater pressure and a more focused massage to various areas of the receiving person's body, primarily due to the opportunity for close proximity to the rear of the massage table assembly combined with the ability to position the masseur's arms and hands directly above the part of the receiving person's body where the massage is to be applied. This benefit is further provided by the configurations of the first support surface 110 and the second support surface 120, which allows the masseur or masseuse to be positioned directly above the hips and lower back of the receiving person. The directional control that may be achieved by a masseur kneeling in this position is also improved as a result of the location and proximity to this area of the receiving person's body. In alternate embodiments or applications the table may be placed upon another support surface, such as a table or bench, for allowing the masseur to be in a standing position. In another alternate embodiment or application, adjustable height legs (not shown here) may be attached to the underside of the massage table assembly for accommodating massage performed by a person in a standing position.

In another alternative embodiment or application, the table may also be arranged and used for a receiving person lying on her back. The presence of the void 130 as described above in the preferred embodiment of the invention does not inhibit the ability to perform a massage on a person lying in a position other than face down. In this alternate embodiment, the head support 140 is adjustable by rotating the headrest 180 degrees around its vertical axis and thereby decreasing the distance between the back of the receiving person's head and the headrest, so that the head of the receiving person may be more conveniently supported in a face-up position.

While the invention has been described in connection with certain preferred embodiments, it is not intended to limit the scope of the invention to the particular apparatus versions set forth above; on the contrary, it is intended to cover such alternatives, modifications and equivalents as may be included within the spirit and scope of the complete invention as defined by the following claims.

We claim:

1. A massage table comprising a bottom plate with vertical structures at each end, each having inner and outer vertical surfaces and supporting two elevated horizontal support surfaces spaced a predetermined distance apart, a central void bounded by the inner edges of said structures supporting said two support surfaces, a pair of vertical support members mechanically fastened to either side of one of said structures and extending upward from either side of one of the two support surfaces, wherein said vertical support members allow for two distinct body positions, with the subject's legs on either the interior or exterior of said support members, and a headrest with a breathing opening in the center, said headrest being removably attached to the outer vertical surface of the structure supporting the other support surface.

2. The massage table of claim 1 wherein the support surface connected with said vertical support members is adapted to accommodate the hip and pelvic areas of a massage subject, and the other support surface is adapted to accommodate the shoulders of said massage subject.

3. The massage table of claim 1 wherein said headrest may be fully detached, rotated 180 degrees along its horizontal axis and re-attached with a different surface exposed to support the subject's head.

4. The massage table of claim 3 wherein said headrest is attached by at least two elongated elements, allowing the headrest to be positioned closer or further away from the vertical exterior surface of the structure supporting said support surfaces.

5. The massage table of claim 1, further comprising at least one mirror placed into said void and/or at the end of the table, facing upward and allowing for improved viewing of the subject's body.

6. The massage table of claim 5 wherein said at least one mirror is illuminated by at least one light placed in at least one recess located between said first and second support surfaces and the bottom plate.

7. The massage table of claim 6, comprising incandescent lighting placed between said second support surface and said bottom plate.

8. The massage table of claim 1 wherein a plurality of pockets are added to at least one side of at least one of said structures supporting said first and second support surfaces.

9. The massage table of claim 1 wherein at least one of said first and second support surfaces is padded and covered with a moisture-resistant, easily cleanable material.

10. A massage table for use on a flat surface, comprising a bottom plate, two support structures attached to opposite ends of said plate to support two padded support surfaces with a void between them, with one padded surface adapted to support the hip and pelvic area of a massage subject, with two vertical support members attached to the sides of the support structure supporting this padded surface and extending vertically above said padded surface, with the padded surface at the opposite end adapted to accommodate the shoulder area of said subject and having an indentation in the center of the outer edge of said padded support surface, further comprising a removable headrest with a breathing opening in the middle, removably attached to the outer edge of the structure supporting said shoulder area padded surfaces, said table further comprising an upward-facing mirror positioned above said bottom plate at the end of the table under said support surface supporting the hip and pelvic area of said subject, at least one upward-facing mirror positioned above said bottom plate in said void, at least one light Positioned under said hip support surface, and a plurality of pockets positioned along at least one side of at least one of the structures supporting the two padded surfaces.

11. A massage table comprising a bottom plate with vertical structures at each end, each having inner and outer vertical surfaces and supporting two elevated horizontal support surfaces spaced a predetermined distance apart, a central void primarily designed to accommodate a woman massage subject's breasts, bounded by the vertical interior surfaces of said structures supporting said two support surfaces and said bottom plate, wherein said central void is open on both sides of said massage table to allow a masseur access to the massage subject's body, a pair of vertical support members mechanically fastened to either side of one of said structures and extending upward from either side of one of the two support surfaces, said vertical support members allowing for two distinct body positions, with the subject's legs on either the interior or exterior of said support members, and a headrest with a breathing opening in the center, said headrest being removably attached to the outer vertical surface of the structure supporting the other support surface.

* * * * *